United States Patent [19]

Martin

[11] 3,975,838

[45] Aug. 24, 1976

[54] SKI BOOT

[76] Inventor: Hans Martin, Chasernweg 7, Kloten, Switzerland

[22] Filed: June 9, 1975

[21] Appl. No.: 584,825

[30] Foreign Application Priority Data

June 20, 1974 Switzerland ..... 8472/74
Nov. 20, 1974 Switzerland ..... 15462/74

[52] U.S. Cl. ..... 36/121; 36/50; 24/71 SK

[51] Int. Cl.[2] ..... A43B 11/00; A43C 11/00

[58] Field of Search ..... 36/50, 2.5 AL; 24/68 R, 24/68 SK, 69 R, 69 SK, 70 R, 70 SK, 71 SK

[56] References Cited

UNITED STATES PATENTS

| | | | |
|---|---|---|---|
| 1,236,797 | 8/1917 | White | 24/69 SK |
| 3,204,307 | 9/1965 | Dunn | 36/50 |
| 3,662,435 | 5/1972 | Allsop | 24/70 SK |

*Primary Examiner*—Patrick D. Lawson
*Attorney, Agent, or Firm*—Roylance, Abrams, Berdo & Kaul

[57] ABSTRACT

A ski boot having an upper part and a fastening mechanism which includes a tension member passing across an opening in the instep portion of the upper part, the tension member comprising a cable extending through guides, one end of the tension member being tightly connected to a clasp in the cuff portion of the ski boot. The clasp is fastened to a tightening strap on one side of the cuff portion and the upper end of the tension cable is attached to a tightening strap on the other side thereof. The upper end of the guide sleeve for the cable is fixed to one tightening strap and the tension member is fixed to a tension flap freely movable over the cuff portion on the instep side of the boot. The tension flap is connectable with the clasp and has a tappet which engages with a shoulder attached to the tightening strap after the tension strap has undergone a predetermined amount of travel. In one embodiment the heel portion of the boot is pivotable about an axis near the sole of the boot and at right angles to the longitudinal axis of the boot. A tightening band extends around the heel portion, the heel portion having an insert or thickened portion. A covering tongue is positioned beneath the clasp in guides and is held in place by the tightening strap. The clasp includes a tightening lever with an extension and covering portion which is pivotally mounted on the clasp and which partially covers the tightening lever. The tension member is connected with the tension flap by a tightening mechanism which includes a star wheel and pawl.

13 Claims, 6 Drawing Figures

SKI BOOT

This invention relates to a ski boot and particularly to an effective and simple fastening mechanism for a ski boot, especially of the plastic type.

A type of fastening mechanism which is particularly well known in connection with ski boots is the tightening lever mechanism for drawing together the closing straps, wherein a plurality of tightening lever mechanisms are distributed over the instep and leg portions of the upper part of the ski boot and which serve to firmly draw together the closing straps. The tightening lever mechanisms also make it possible to adjust the force with which the ski boot is tightened, while the loosening of the boot can also be accomplished in a simple manner.

It is recognized that plastic ski boots require fewer tightening lever mechanisms than ski boots made of a more flexible material, but, due to the greater rigidity of the plastic boots, it is somewhat more difficult to insert one's foot into the boot. Accordingly, a further opening with a fastening mechanism is provided on the top, particularly in the heel portion. Both fastening mechanisms, that is, the one used for tightening purposes and that used for facilitating getting the foot into the boot, are opened when putting on the ski boot.

The prior art includes a boot wherein the tightening of the boot is brought about by means of a single tightening mechanism, this being shown in U.S. Pat. No. 3,545,106. For this purpose, a tension cord guided in guides is alternately positioned over the closing straps, whereby at its upper end the cord is connected with a single tightening lever mechanism positioned in two tightening straps of the cuff portion on the instep side. A shoulder supported on one of the tightening straps is provided to engage the guide, for example, the end of a Bowden cable covering, loosely supported under the other tightening strap. On tightening the tightening mechanism the shoulder moves counter to the movement of the tension cable and forces back the guide, for example, the cable covering, so that the tightening path of the tension cable is maintained despite the drawing together of the closing straps. However, this mechanism is relatively large because the shoulder is shaped onto an arm of a baseplate fixed to one of the tightening straps and, in the form of a rigid bar, projects against the other tightening strap.

An object of the present invention is to provide a ski boot construction of the type indicated hereinbefore in such a way that an adequate tightening of the ski boot can be brought about without it being necessary to support the guide by means of a shoulder, thereby leading to a simpler and more pliable fastening mechanism and facilitating getting one's foot into the boot.

According to the present invention, an apparatus is provided in which the upper end of a guide is fixed to one tightening strap and the tension member is fixed to a tension flap freely movable over the cuff portion on the instep side and connectable with a clasp, and having a tappet in which, on tightening the tension member with the clasp, engages with a shoulder positioned on the tightening strap after a predetermined amount of travel.

In order that the manner in which the foregoing and other objects are attained in accordance with the invention can be understood in detail, particularly advantageous embodiments thereof will be described with reference to the accompanying drawings, which form a part of the specification, and wherein.

Figure 2:
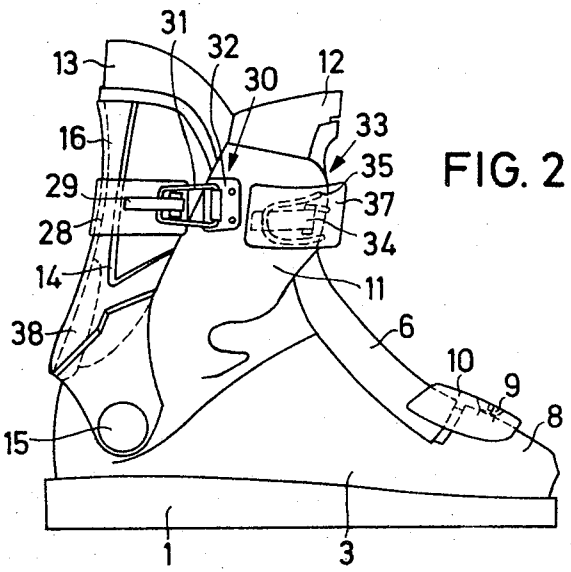
FIG. 2 is a side elevation of the ski boot of FIG. 1.
Figure 1:
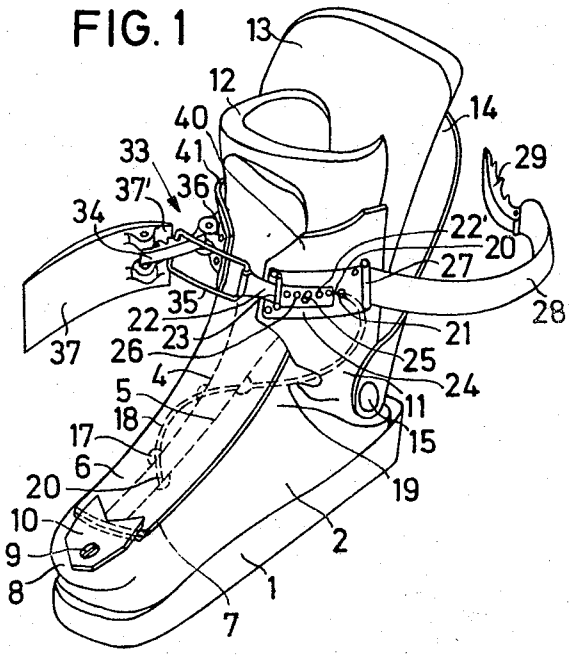
FIG. 1 is a perspective view of a ski boot having a single fastening mechanism according to the invention.

The ski boot shown in FIGS. 1 and 2 has a sole 1 onto which is formed an upper part 2 with an opening on the instep side whose edges 4 and 5, shown by dotted lines, are covered by a covering tongue 6. The covering tongue can be moved longitudinally in a guide 7 of upper part 2 so that it can adapt to the foot on drawing together edges 4 and 5. Thus, covering tongue 6 is not fixed to the cap portion 8 of upper part 2 but is held in position by a decorative and cover plate 10 fixed to cap portion 8 by a screw 9. The heel side of cuff portion 11 of upper part 2 is open to permit entry from the rear.

In upper part 2 is inserted a padded inner boot whose upper part 12 is also open on the heel side. Upper part 12 is coverable by means of a heel tongue 13 which is fixed to upper part 12 in the vicinity of the inner boot sole.

Heel tongue 13 is covered by a heel portion 14 pivotally mounted in the vicinity of sole 1 with two bolts 15 in the rear end of upper part 2. Heel portion 14, together with heel tongue 13 of the inner boot, can be tilted rearwardly to facilitate getting one's foot into the ski boot and can be provided with reinforcement 6 in the form of elevated portions which simultaneously serve as decorations.

Attachment flaps 17 for securing guides 18 and 19 are fixed to edges 4 and 5 of upper part 2. Guides 18 and 19 can, for example, be a Bowden cable covering whose inner cable bridges the gap between edges 4 and 5 and serves as tension member 20 for tightening the ski boot. The end of guide 19 passing between the inner and outer boot is fixed to a tightening strap 40 of cuff portion 11 in the immediate vicinity of an opening 21 while tension member 20 extends through opening 21 and is connected with a tension flap 22. Tension flap 22 extends through a shoulder 23 fixed to a plate 24 positioned on tightening strap 40. Tension flap 22 has a bolt-shaped tappet 25 which can be arranged in different positions in openings 26 in tension flap 22. In the same way, tension member 20 can be adjustably connected with tension flap 22 by means of bores 22'.

On plate 24 is pivotally mounted by means of a hinge 27 a tension band 28 on whose free end is positioned a tightening lever 29 of a clasp 30 (FIG. 2). Clasp 30 serves to hold heel portion 14 on cuff portion 11. Clasp 30 comprises a toothed tightening lever 29 and a shackle 31 fixed to cuff portion 11 by a plate 32.

A further clasp 33 serves to tighten edges 4 and 5 of upper part 2 and cuff portion 11. Clasp 33 has a tightening lever 34 and a shackle 35. Tightening lever 34 is pivotally fixed by means of a plate 36 to a tightening strap 41 of cuff portion 11, while shackle 35 is pivotally connected with tension flap 22. An extension and covering portion 37 is connected in articulated manner to the free end of tightening lever 34 which facilitates the closing movement of lever 34 and, after closing the same, covers clasp 33. As portion 37 projects over tightening lever 34 by means of its end 37' when tightening lever 34 is closed, covering portion 37 is located over the clasp 33 and is held in this position. This is also the case when clasp 33 is fully open and the back of tightening lever 34 is placed against covering tongue 6. Due to its overhanging portion, covering portion 37 is then held on clasp 33 and cannot pivot free.

On tightening clasp 33 the extension and covering portion 37 is raised until it is supported on the tightening lever 34 by means of its end which covers the latter. Shackle 35 is then inserted in an appropriate tooth of tightening lever 34. The covering portion 37 with tightening lever 34 is now moved in order to reduce the distance between tappet 25 and shoulder 23 resulting in the tightening of the instep portion of upper part 2. If tappet 25 engages with shoulder 23, cuff portion 11 is also tightened. Just before passing beyond the dead center position of tightening lever 34, covering and extension portion 37 is flapped over the covering tongue, so that with tightening lever 34 fully engaged, portion 37 is positioned substantially free from play over clasp 33.

The closing movement of clasp 33 only takes place when tightening lever 29 of clasp 30 has been inserted in shackle 31 and heel portion 14 is held snugly on cuff portion 11.

If the tightened ski boot is to be loosened, the tightening lever 34 is opened with the aid of covering and extension portion 37. The back of tightening lever 34 now engages with covering tongue 6, so that portion 37 is located substantially without play on clasp 33. Despite the fact that shackle 35 is not removed from tightening lever 34, the loosening of the ski boot is so great that comfortable walking is possible. To remove the ski boot, the clasp 30 is opened, the heel portion 14 and heel tongue 13 are lowered and the foot can be removed from the ski boot through the opening which is provided on the heel side.

It is important that with clasp 33 there is, successively, first tightening of the instep portion of upper part 2 by tension member 20 and, subsequently, there is tightening of gaps 40 and 41 by applying tappet 25 to closing strap 23. By adjusting the attachment point of tension member 20 on tension flap 22 and/or by adjusting tappet 25, the tension of the instep portion of upper part 2 or cuff portion 11 can be correspondingly adjusted. Without tappet 25 or shoulder 23, the tightening of the ski boot is still possible but then tension member 20 comes under the action of the entire tensional force whereas when applying tappet 25 to shoulder 23 only that tensional force portion used for tightening the instep portion is effective.

An insert 38 is fixed to the inside of heel portion 14 which, with the ski boot tightened, improves the hold of the foot in the boot, particularly when the boot cuff is moved in the direction of the toe. As the heel portion 14 is pivotally mounted close to the sole, a pressure is exerted on the foot of the skier by insert 38 through moving the cuff in the direction of the toe, so that the foot is forced more firmly into the boot.

Figure 4:
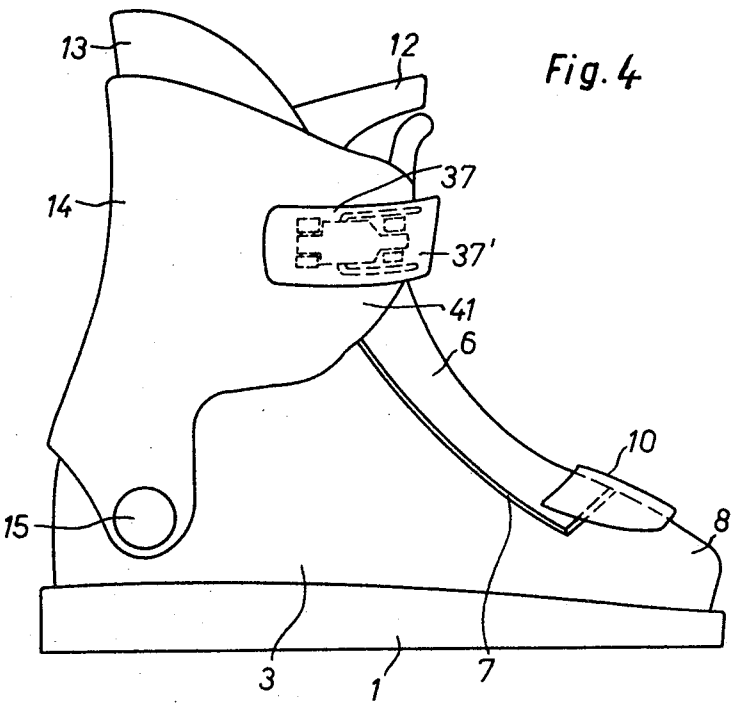
FIG. 4 is a side elevation of the ski boot of FIG. 3.
Figure 3:
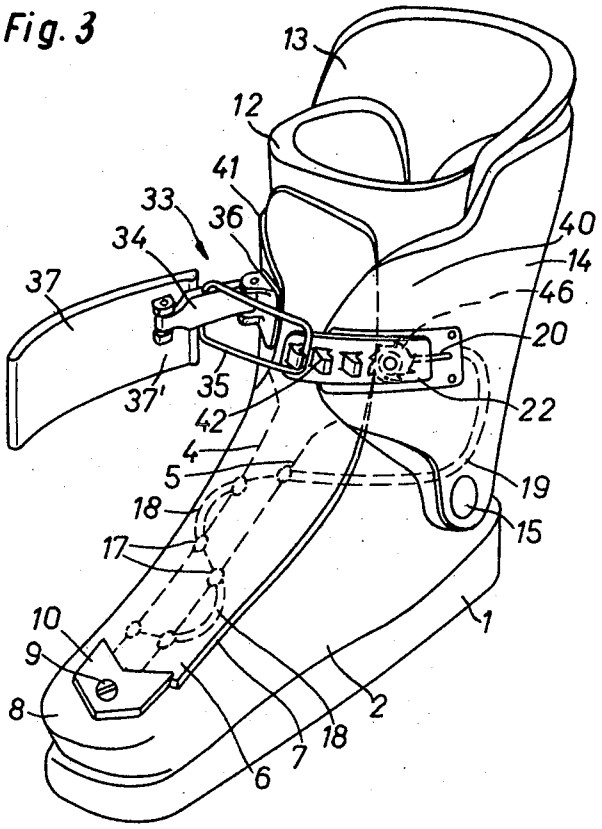
FIG. 3 is a perspective view of a ski boot having a single fastening mechanism in accordance with the invention.

In FIGS. 3 and 4 the reference numerals used in FIGS. 1 and 2 have the same meanings and are not therefore described again.

Figure 5:
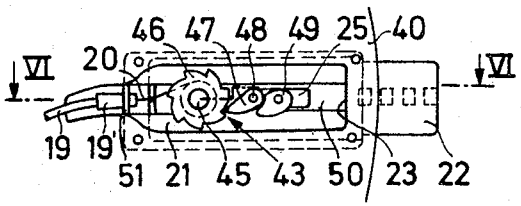
FIG. 5 is an enlarged partial view of the inside of the fastening mechanism of the ski boot of FIG. 3.
Figure 6:
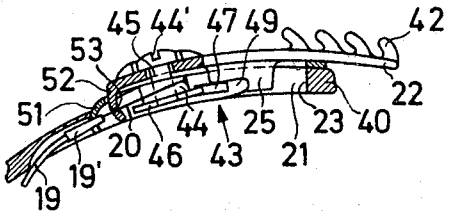
FIG. 6 is a sectional view along line VI—VI of FIG. 5.

The construction of clasp 33 varies slightly from that of FIGS. 1 and 2. Guide 19 is connected with tightening strap 40 in the immediate vicinity of opening 21 (FIGS. 5 and 6) whereby strap 40, together with the facing strap 41, form in each case a section of heel portion 14 extending on the instep side. Tension member 20 extends into opening 21 and is connected with tension flap 22 by means of a tightening mechanism 43. Tension flap 22, which has hooks 42 on its front for suspending shackle 35, is provided on its rear with tappet 25, while the rim of opening 21 forms shoulder 23.

Tightening mechanism 43 has a reel 44 which is rotatable about a pin 45 and to which is fixed a star wheel 46, the teeth of which engage a pawl 47 which is pivotally mounted on a pin 48. Pawl 47 is under the spring action of a sprung pad 49, e.g., of rubber, which it forces against wheel 46. The end of tension member 20 is fixed to reel 44 which can be rotated, e.g., by inserting a screwdriver in a slot 44' on the front thereof, to tighten tension member 20. For relieving tension member 20, pawl 47 must be removed from star wheel 46 counter to the action of spring pad 49. The tightening mechanism 43 is used to adjust the tension in the instep portion of the ski boot. Guide 19 is fixed to a plate 51 by means of an end section 19' (FIGS. 5 and 6), while plate 51 is fixed to a tightening strap 40 and has an opening corresponding to opening 21. Tension flap 22 has an angular portion 52 with a guidance opening 53 for tension member 20.

In the case of clasp 33 according to FIGS. 3 and 4, shackle 35 is pivotally mounted on tightening lever 34, whereby shackle 35 can be hung on hook 42 of tension flap 22 but the function remains unchanged. However, a basic difference is provided by the fact that clasp 33 according to FIGS. 3 and 4 can be completely removed from tension flap 22. Consequently, tightening straps 40 and 41 can be combined into a single part with heel portion 14, making tightening band 28 superfluous. Thus, the construction of the ski boot is simplified.

The described embodiments of the ski boot correspond to the requirements which are made on a functionally advantageous boot. It can be tightened with a single tightening mechanism or clasp, whereby through the individual tightening of the instep portion and the cuff portion, the foot has a completely satisfactory and tolerance-free hold. After loosening the clasp and pivoting back heel portion 14, it is possible to get into and out of the boot without difficulty. If clasp 33 is loosened without disengaging the connection with tension flap 22, it is possible to walk in a normal and comfortable manner in the ski boot. Through the special construction of the extension and covering portion 37, any moving around of loose parts of the clasp is avoided.

While certain advantageous embodiments have been chosen to illustrate the invention, it will be understood by those skilled in the art that various changes and modifications can be made therein without departing from the scope of the invention as defined in the appended claims.

What is claimed is:

1. A ski boot having an upper part and a fastening mechanism for tightening the upper part about a foot, the fastening mechanism comprising a tension member extending across an opening in the instep portion of the upper part;

a clasp in the cuff portion of the ski boot, one end of said tension member being tightly connected to said clasp, said clasp being openable on the instep side of the boot;

first and second tightening straps on opposite sides of the cuff portion, guide means for said tension member, one end of said guide means being attached to one of said first and second straps, shoulder means fixedly attached to said one of said first and second straps; and a tension flap freely movable over the cuff portion on the instep side of the boot, said tension flap being connectable with said clasp, said tension flap having a tappet which engages with said shoulder means on said tightening strap after said clasp has moved said tension flap through a predetermined amount of travel.

2. A ski boot according to claim 1, wherein said shoulder means is connected with the tightening strap via a plate whereon is fixed a tightening band engaging a heel portion and a second clasp is provided on the cuff portion.

3. A ski boot according to claim 1, wherein said tightening straps are connected at one end with the upper part and on the other are interconnected via a tightening band.

4. A ski boot according to claim 3, wherein on the inside of the heel portion is provided a thickened portion.

5. A ski boot according to claim 1, wherein the heel portion has a pivot axis adjacent to the sole and at right angles to the ski boot longitudinal axis.

6. A ski boot according to claim 5, wherein on the inside of the heel portion is provided a thickened portion.

7. A ski boot according to claim 1, wherein said clasp is positioned over a covering tongue displaceably guided in a guide and held in place by said tightening straps.

8. A ski boot according to claim 1, wherein said clasp has a tightening lever with an extension and covering portion pivotally mounted thereon and partially covering the tightening lever, which covering portion covers said clasp substantially without play in both the closed position and in the fully open position of the tightening lever.

9. A ski boot according to claim 1, wherein said tension member and tappet are adjustable relative to said tension flap.

10. A ski boot according to claim 1, wherein said tightening straps are interconnected on the heel side and are parts of the heel portion.

11. A ski boot according to claim 1, wherein said tension flap has hooks wherein can be hooked the shackle of the clasp.

12. A ski boot according to claim 1, wherein said tension member is connected with said tension flap by a tightening mechanism comprising a star wheel with a pawl.

13. A ski boot according to claim 12, wherein the back of said tension flap is connected with the tension member and the tappet, by said tightening mechanism, whereby the tightening member and tappet project into an opening of the tightening strap whose one rim forms said shoulder means.

* * * * *